US007497368B2

(12) United States Patent
Lutzke

(10) Patent No.: US 7,497,368 B2
(45) Date of Patent: Mar. 3, 2009

(54) UNIVERSAL MOUNTING ASSEMBLY

(76) Inventor: David E. Lutzke, 5505 Regent St., Madison, WI (US) 53705

( * ) Notice: Subject to any disclaimer, the term of this patent is extended or adjusted under 35 U.S.C. 154(b) by 112 days.

(21) Appl. No.: 11/608,630

(22) Filed: Dec. 8, 2006

(65) Prior Publication Data

US 2007/0152030 A1 Jul. 5, 2007

Related U.S. Application Data

(63) Continuation-in-part of application No. 11/534,301, filed on Sep. 22, 2006, now Pat. No. 7,185,803, which is a continuation-in-part of application No. 11/325,725, filed on Jan. 5, 2006, now abandoned.

(51) Int. Cl.
*A47G 29/12* (2006.01)

(52) U.S. Cl. ..... 232/39; 248/218.4

(58) Field of Classification Search ..... 232/39; D99/32; 248/218.4, 219.1, 219.2, 219.3, 248/219.4, 300, 146, 149, 152
See application file for complete search history.

(56) References Cited

U.S. PATENT DOCUMENTS

| | | | |
|---|---|---|---|
| 2,440,576 | A | 4/1948 | De Haas |
| 2,552,915 | A | 5/1951 | Zachrich |
| 4,120,446 | A | 10/1978 | Fuemmeler |
| 4,403,730 | A | 9/1983 | Batson |
| 4,709,853 | A | 12/1987 | Hahn |
| 4,724,998 | A | 2/1988 | Long et al. |
| 4,951,905 | A | 8/1990 | Bronson et al. |
| 4,966,309 | A | 10/1990 | Baer |
| 5,060,908 | A | 10/1991 | Sofy |
| 5,169,062 | A | 12/1992 | Baker |
| 5,337,954 | A | 8/1994 | Kobilarcik et al. |
| 5,386,938 | A | 2/1995 | West |
| 5,509,603 | A | 4/1996 | Hering |
| 5,664,748 | A | 9/1997 | Speece et al. |
| 6,402,023 | B1 | 6/2002 | Beaudry et al. |
| 6,955,291 | B1 | 10/2005 | Knight |
| 7,172,163 | B1 * | 2/2007 | Johnson ..... 248/146 |
| 2005/0127259 | A1 | 6/2005 | Riker |

OTHER PUBLICATIONS

"Universal Mailbox Mounting Plate" product label, Solar Group Inc., prior to Dec. 2006.
Photos of Universal Mailbox Mounting Plate, Solar Group Inc., prior to Dec. 2006.

* cited by examiner

*Primary Examiner*—William L. Miller
(74) *Attorney, Agent, or Firm*—Stiennon & Stiennon

(57) ABSTRACT

A mailbox is mounted to two perpendicular faces of a post by a mounting assembly main bracket with two perpendicular flanges. The main bracket has a horizontal top wall from which two diverging sidewalls extend downwardly. The top wall has two sets of perpendicular slots, which receive two parallel right angle top brackets to receive the mailbox in a position either partially overlying the top of the post, projecting from the post, or offset from the post in a transverse orientation. Another embodiment has a main bracket with an integral top bracket, and only one adjustable top bracket. For sale, the top brackets mount to the main bracket by a label sheet wrapping the top wall and holding a fastener container.

18 Claims, 7 Drawing Sheets

UNIVERSAL MOUNTING ASSEMBLY

CROSS REFERENCES TO RELATED APPLICATIONS

This application is a continuation-in-part of U.S. application Ser. No. 11/534,301, filed Sep. 22, 2006, now U.S. Pat. No. 7,185,803, which is a continuation-in-part of application Ser. No. 11/325,725, filed Jan. 5, 2006, now abandoned, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to brackets in general, and to assemblies for connecting mailboxes to posts in particular.

Stanchion mounted mailboxes have been associated with rural areas as postal carriers seldom travel the long, rugged driveways associated with farms or remote locations. More recently, efforts to obtain greater letter carrier efficiency have meant that mail deliveries to the homeowner's door have been curtailed for newer construction, making the roadside mailbox more prevalent in suburbia, and even in newer urban developments.

Most roadside mailboxes are mounted to a post in order to elevate the mail receptacle in a manner conducive to drive-up usage by a postal carrier working out of a truck or car, thereby increasing the efficiency of mail delivery. The post in many cases is made of wood due to its low cost and ability to withstand the rigors of outdoor use. In addition, wood posts offer adequate strength and classic appeal in a variety of settings.

In one common configuration, a wooden cross member or arm is connected to a wooden post at a height adequate for drive-up usage. The arm provides support for the mailbox cantilevered from the post. The cantilever provided by the arm is important as in many situations the postal worker must contend with curbs or ditches that reduce the allowable distance from the vehicle to the mailbox. Although the cantilever offers a positioning benefit, it also creates a lever action that places stress on the joint with the post. As a result of this stress, and the natural movement of wood as it expands and contracts, the joint between the post and the arm is a significant point of failure. Even if the joint doesn't completely fail, over time the arm may become loose and sag. To prevent sagging or deflection, the arm is sometimes braced by another wooden member extending between the arm and the post. In addition to these two members, post mounted mailboxes also require additional components, fabricated from wood, plastic, or steel that serve as the mounting apparatus for the mail box itself. In some cases the mounting apparatus is an assembly of small brackets, however in most cases it is a mounting board. The board is attached to the cantilever arm, and the mailbox is then attached to the mounting board.

The usual method of construction of the cantilevered arm involves a tongue on the arm which extends into a groove or recess on the post. This traditional wood joinery technique requires skills and equipment not possessed by all homeowners. As a result, mass produced kits are available, but often such assemblies can be lacking in a desired quality of fit and appearance.

Various specialized mounting brackets are available, either configured to a specialized mailbox, or designed to mount a standard mailbox in a specified fashion. Preferably a single bracket would offer a variety of mounting options to the user.

SUMMARY OF THE INVENTION

The mailbox mounting assembly of this invention mounts a conventional mailbox to a standard dimensioned lumber post. The mounting assembly has a main bracket which mounts to two perpendicular faces of the post by two perpendicular flanges. The main bracket has a horizontal top wall from which two diverging sidewalls extend downwardly. The top wall has two sets of perpendicular slots, which receive two parallel right angle top brackets to receive the mailbox in a position either partially overlying the top of the post, projecting from the post, or offset from the post in a transverse orientation. Another embodiment has a main bracket with an integral top bracket, and only one adjustable top bracket.

It is an object of the present invention to provide a universal mounting assembly for mailboxes of various widths for attachment to posts in a variety of positions.

It is a further object of the present invention to provide a mounting assembly for mailboxes which can be economically fabricated of metal or plastic.

It is an additional object of the present invention to provide a box mounting assembly and a packaging assembly which is compact and economical.

It is another object of the present invention to provide a mounting assembly for mailboxes which can be nested compactly with other like assemblies for economical transport and display.

Further objects, features and advantages of the invention will be apparent from the following detailed description when taken in conjunction with the accompanying drawings.

DESCRIPTION OF THE PREFERRED EMBODIMENTS

Figure 1:
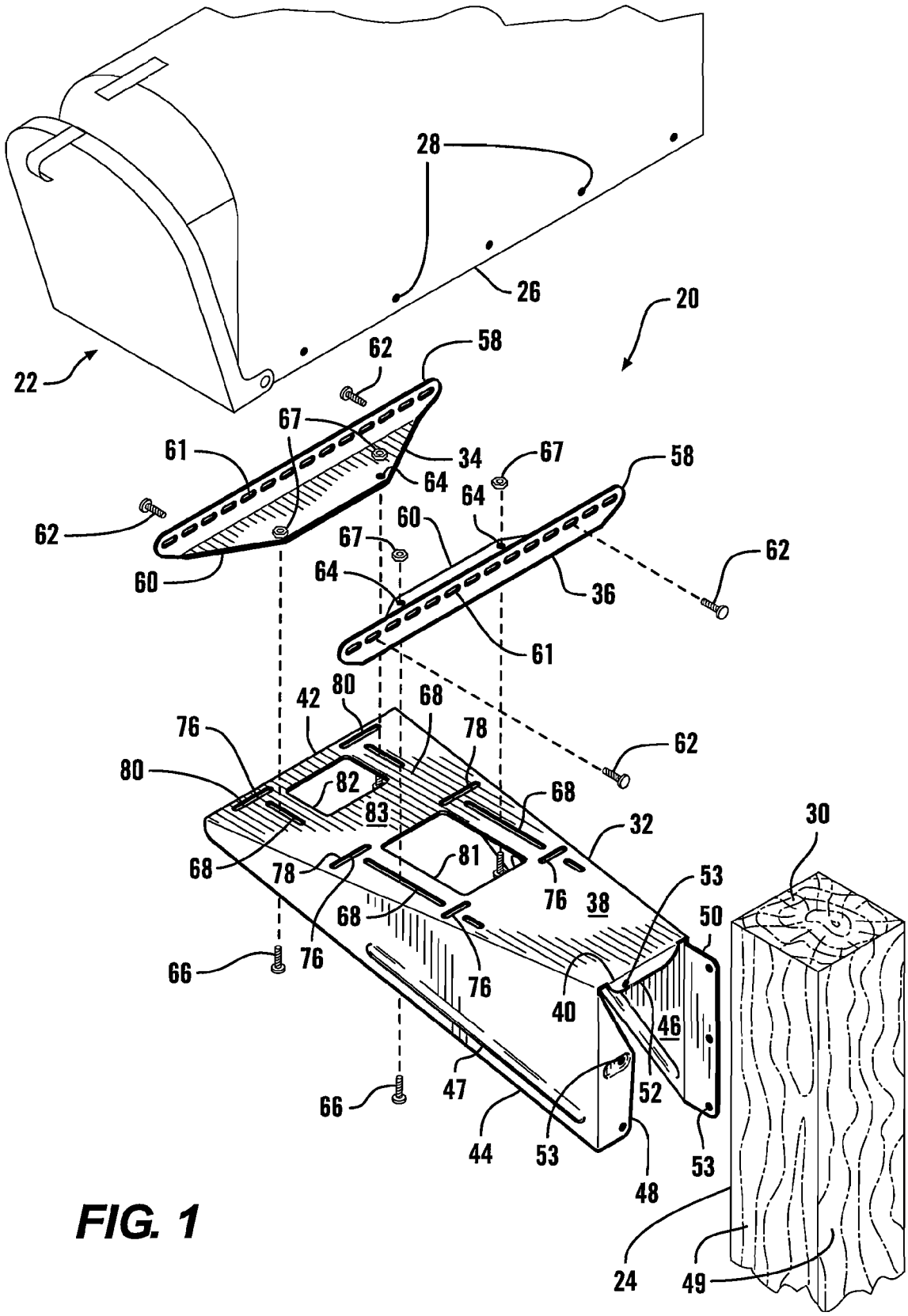
FIG. 1 is an exploded isometric view of the mailbox mounting assembly of this invention.
Figure 2:
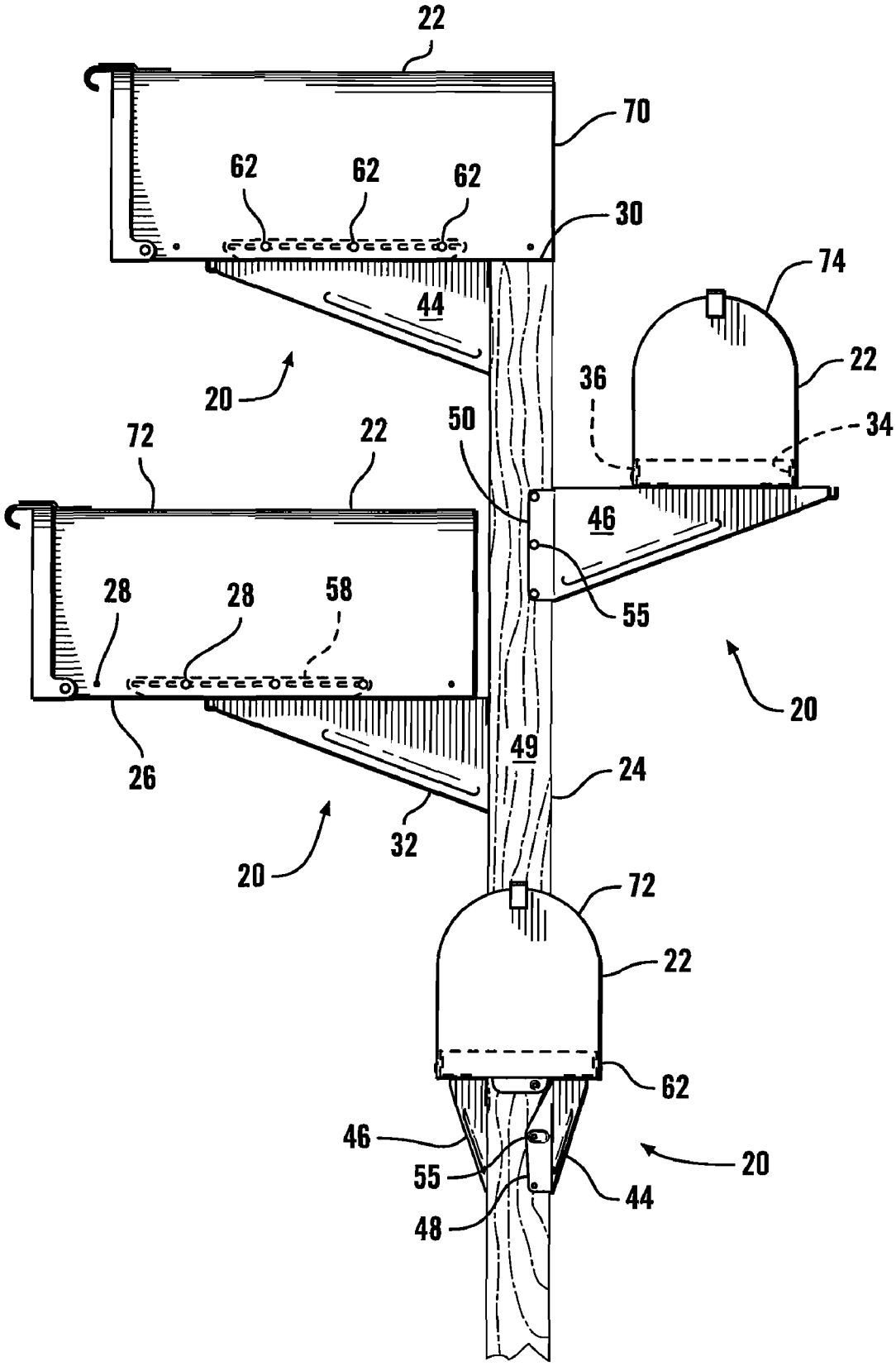
FIG. 2 is a front elevational view of the mailbox mounting assembly of FIG. 1, mounted to a wooden post in various configurations.

Referring more particularly to FIGS. 1-8, wherein like numbers refer to similar parts, a mailbox mounting assembly 20 is shown in FIGS. 1 and 2. The assembly 20 securely mounts a conventional mailbox 22 to a conventional wooden post 24. Mailboxes 22 are available in a variety of sizes and heights, but usually have downwardly projecting lips 26 which are provided with mounting holes 28 which extend sidewardly through the lips 26. The post 24 will typically be a treated dimensioned lumber member, with nominal dimensions of 4×4 inches (actual dimensions of about 3½ by 3½ inches), 4×6, or 6×6 inches. The post 24 has a lower end, not shown, which extends into the ground or is otherwise fastened, and an upper end 30 to which the mailbox 22 is attached by the mounting assembly 20.

The mailbox mounting assembly 20 has a single main bracket 32 to which a first top bracket 34 and a second top bracket 36 are positionably connected. As shown in FIG. 1, the main bracket 32 is formed of bent sheet metal, for example galvanized, painted, or powder coated steel, or any other weather resistant material. The thickness of the metal sheet may be for example, 18-20 gauge. The main bracket 32 has a horizontal top wall 38 which underlies the mailbox 22. The main bracket 32 top wall 38 is in the shape of a truncated triangle, and expands in width as it extends from a post edge 40 which is adjacent the post 24. The top wall 38 is at its widest at its furthest from the post where it terminates at a free edge 42. A first side wall 44 and a second side wall 46 are spaced from one another, and extend downwardly from the main bracket top wall 38. Although both side walls 44, 46 are perpendicular to the top wall 38, they are not parallel to each other, but instead diverge as they extend away from the post 24. This divergence provides greater clearance when it comes to fastening the main bracket 32 to the post 24, and facilitates nesting of brackets 32, as discussed below. The side walls 44, 46 may be provided with stiffening ribs 47.

The main bracket 32 is mounted to the post 24 by a rear attachment flange 48 which extends from the first side wall 44 in a plane which is perpendicular to the top wall 38, and a side attachment flange 50 which extends from the second side wall 46 in a plane which is perpendicular to the top wall and to the rear flange. The rear flange 48 and the side flange 50 are positioned to engage perpendicular faces 49 of the upright post 24. Because of this perpendicular arrangement of the flanges, when both flanges 48, 50, are engaged with perpendicular faces of the upright post 24, the top wall will be horizontal (assuming the post is truly vertical). A top flange 52 preferably extends downwardly perpendicular to the top wall, and provides a further fastening location. Each of the side flange 50, the top flange 52, and the rear flange 48 has a plurality of attachment holes 53, through which fasteners 55, shown in FIG. 2, extend into the post. The fasteners 55 may be nails or screws, for example 1⅝ inch long deck screws. It should be noted that two attachment flanges, each extending from one of the top wall and the side walls, and each perpendicular to the top wall as well as to each other, may be employed to mount the main bracket in a proper relation to the post.

The first top bracket 34 and the second top bracket 36 are connected to the main bracket 32 and serve to mount the mailbox 22 to the main bracket. The two top brackets 34, 36 are identical, and each has a side segment 58 which extends upwardly from a bottom segment 60. The side segments 58 have a plurality of side fastener openings or slots 61. The side slots 61 are positioned to mate with the mounting holes 28 in the downwardly projecting lips 26 of the mailbox 22, and to be fastened thereto by fasteners 62, as shown in FIG. 2. The fasteners 62 will engage with nuts, not shown, on the interior of the lips 26. The bottom segments 58 each have two fastener holes 64 which are spaced a set distance from each other. Each fastener hole 64 may have nuts 67 fixed to the bottom segments aligned with the holes 64. The nuts 67 may be PEM-sert® inserts available from PennEngineeing, of Danboro, Pa.

As shown in FIG. 2, the mailbox mounting assembly 20 may be attached to the mailbox and the post 24 in several ways. The mailbox 22 may be positioned in a top mounting arrangement 70 in which portions of the mailbox overlie the upper end 30 of the post, and extends in the first direction of the main bracket. Alternatively, the mailbox may be positioned in an intermediate arrangement 72 in which the mailbox 22 is projecting out from the post 24, but still extending in the first direction of the main bracket.

The first top bracket 34 and the second top bracket 36 are connected to the main bracket 32 by screw fasteners 66, shown in FIG. 1, which extend through slots in the top wall 38 of the main bracket 32 and into the nuts 67. The top wall 38 has two sets of openings or slots to allow the mailbox 22 to be mounted either aligned with the long axis of the main bracket or perpendicular to the long axis of the main bracket 32. For mounting in a transverse arrangement 74, as shown in FIG. 1, the fasteners are connected through first slots 68. The first slots 68 extend in a first direction running from the post edge 40 to the free edge 42 of the main bracket top wall 38. There are two pairs of first slots 68, each pair being comprised of two parallel slots which extend in the first direction. The pairs of first slots 68 are spaced from each other in the first direction. Each of the screw fasteners 66 extends into one of the first slots 68. Because the first top bracket 34 and the second top bracket 36 will be fastened to the mailbox 22 when they are mounted to the main bracket 32, the fasteners are slidable within the first slots 68 until the mailbox is in the desired position, at which point the fasteners 66 may be tightened into the nuts 67 to fix the mailbox 22 in place.

To mount the mailbox 22 in a top mounting arrangement 70 in which portions of the mailbox overlie the upper end 30 of the post, as shown in FIG. 2, the fasteners 66 extend into two near end second slots 76 and two middle second slots 78. The near ends second slots 76 are aligned with each other and extend in a second direction which is perpendicular to the first direction. The middle second slots 78 are also aligned with each other and extend in the second direction. The middle second slots 78 are spaced from the near end second slots 76 the same distance as the set distance spacing between the two fastener holes 64 in the bottom segments of the first top bracket 34 and the second top bracket 36. Because the second slots extend in the second direction, they will accommodate a range of mailbox widths.

To mount the mailbox in an intermediate arrangement 72 in which the mailbox 22 is projecting out from the post 24, but still extending in the first direction, the fasteners 66 extend into the two middle second slots 78 and two far end second slots 80. The far end second slots 80 are aligned with each other and extend in the second direction.

The main bracket 32 top wall 38 may be provided with cut-outs 81, 82, shown in FIG. 1, which reduce the weight and material usage of the main bracket. The cut-outs 81, 82 are positioned on either side of a support segment 83 formed in the top wall 38. The support segment 83 helps to support a box of fasteners when the assembly 20 is in a shipping configuration as discussed below.

It will be observed that the mailbox mounting assembly 20 permits mailboxes of a variety of sizes to be readily mounted to a post in a secure fashion by an unskilled craftsman in a variety of positions. The craftsman first fastens the side segments 58 of the first top bracket 34 and the second top bracket 36 to the downwardly extending lips 26 of the mailbox 22. The main bracket 32 is then mounted to the post 24 by aligning the rear flange and the side flange with the perpendicular vertical faces 49 of the post, and driving fasteners 55, either nails or screws, through the holes 53 in the flanges. The diverging first side wall 44 and second side wall 46 of the main bracket 32 provide adequate clearance to reach fasteners which pass through the rear flange and the top flange into the post 24. No level is required.

Once the top brackets 34, 36 are mounted to the mailbox, and the main bracket 32 is mounted to the post 24, it is a simple matter for the craftsman to mount the mailbox 22 and top brackets assembly to the main bracket in one of the three arrangements shown in FIG. 2. The craftsman sets the mailbox and top brackets assembly into place to align the holes in the top brackets with either first slots 68 or second slots 76, depending on the desired orientation of the mailbox, and then inserts threaded fasteners through the aligned openings, and engages the fasteners with the nuts 67.

Figure 4:
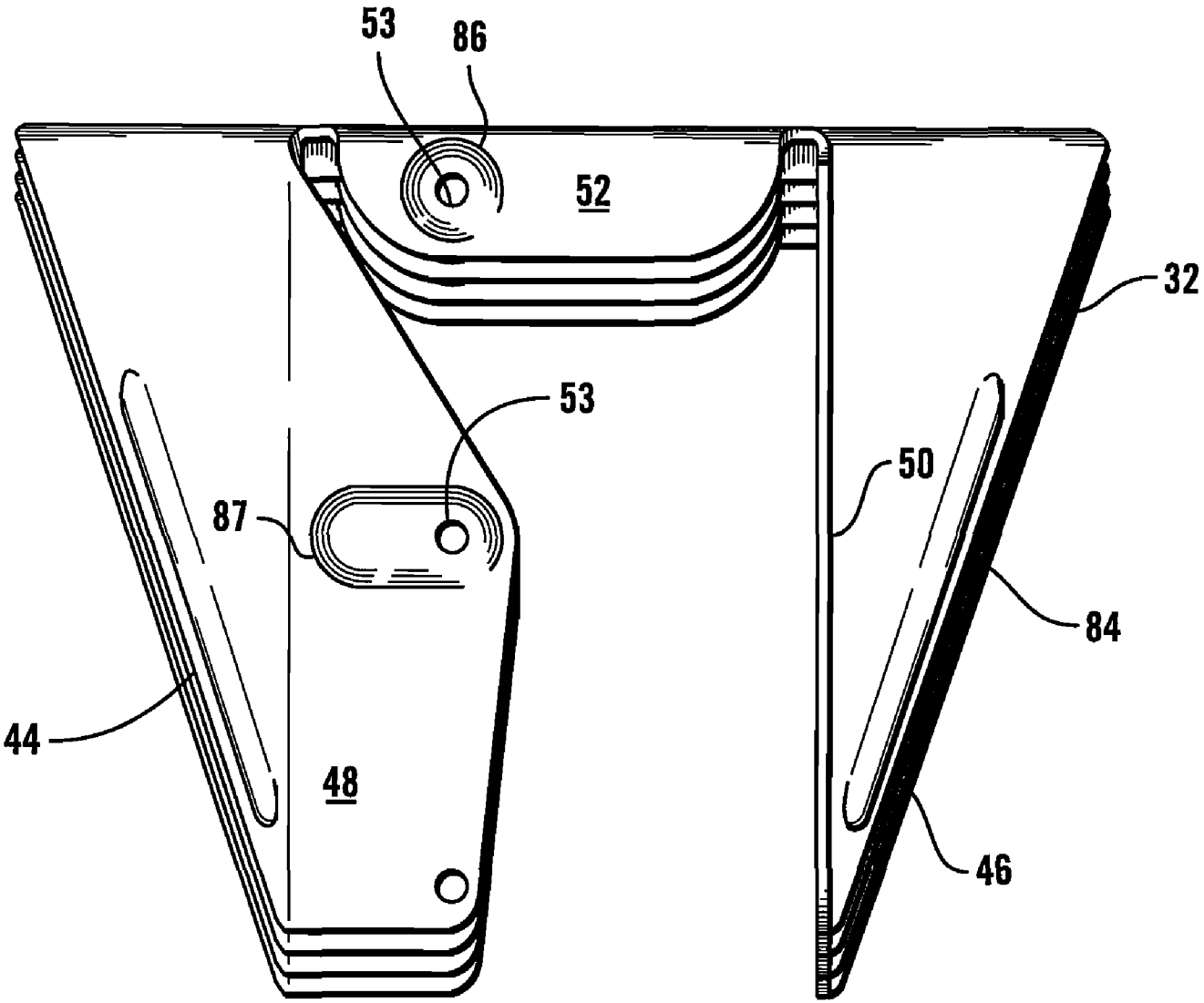
FIG. 4 is a rear elevational view of a stack of main brackets of the mailbox mounting assembly of FIG. 1 having raised crowns around some mounting holes.

As shown in FIG. 4, some of the main bracket 32 attachment holes 53 may be provided with upraised crowns, so that fastening screws may be used which will leave no protruding head. Each attachment hole 53 may have a generally circular crown 86, as on the top flange 52, or an oblong crown 87, as on the rear flange 48. The close nesting of the main brackets 84 which facilitates economical shipment and storage, is illustrated in FIG. 4. Because the side walls 44, 46 are not parallel, one main bracket can be compactly received within another.

Figure 8:
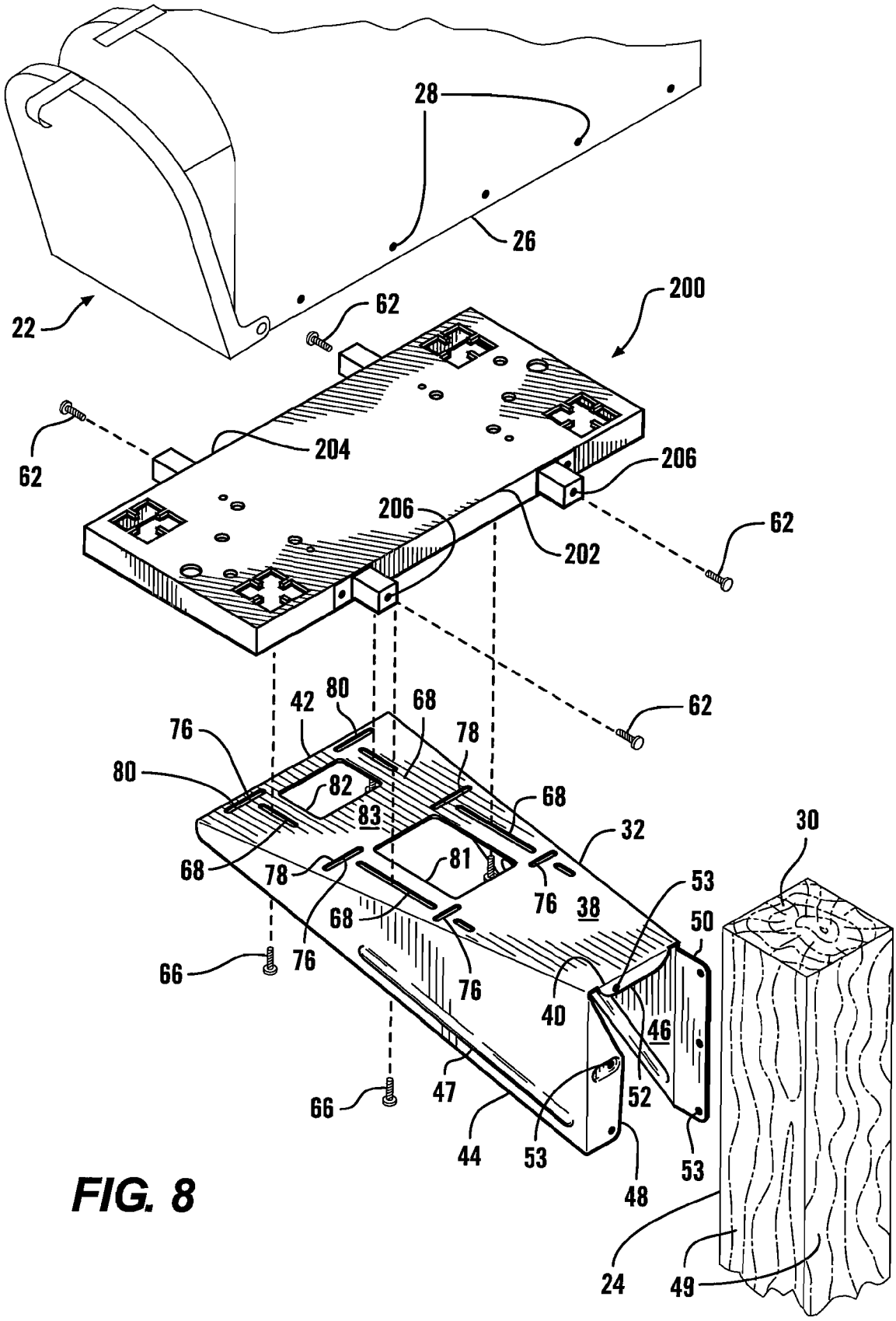
FIG. 8 is an exploded isometric view of an alternative mounting assembly of this invention.

It should be noted that the main bracket 32, may be used with a mailbox mounted to a top mounting assembly such as a conventional wooden board which is connected to the mailbox, or another stiff member such as, as shown in FIG. 8, a conventional plastic universal mounting mailbox mounting plate, such as prior art part #PLMB, manufactured by Solar Group Inc., Taylorsville, Miss. The top mounting assembly 200 has a first side segment 202 which extends upwardly from the top wall of the main bracket, and a second side segment 204 spaced parallel to the first side segment which also extends upwardly from the top wall of the main bracket. The side segments 202, 204, may be planar elements or the side portions of a block of wood, or, as shown, they may be protruding adjustable parts that allow the mounting assembly to accommodate a wider box. The first side segment and the second side segment have sidewardly opening fastener holes 206 through which fasteners 62 extend to engage the mailbox to the top mounting assembly. The top mounting assembly 200 is connected by fasteners 66 extending between the top mounting assembly and the slots 68 in the main bracket to mount the engaged box to the top wall of the main bracket.

Figure 5:
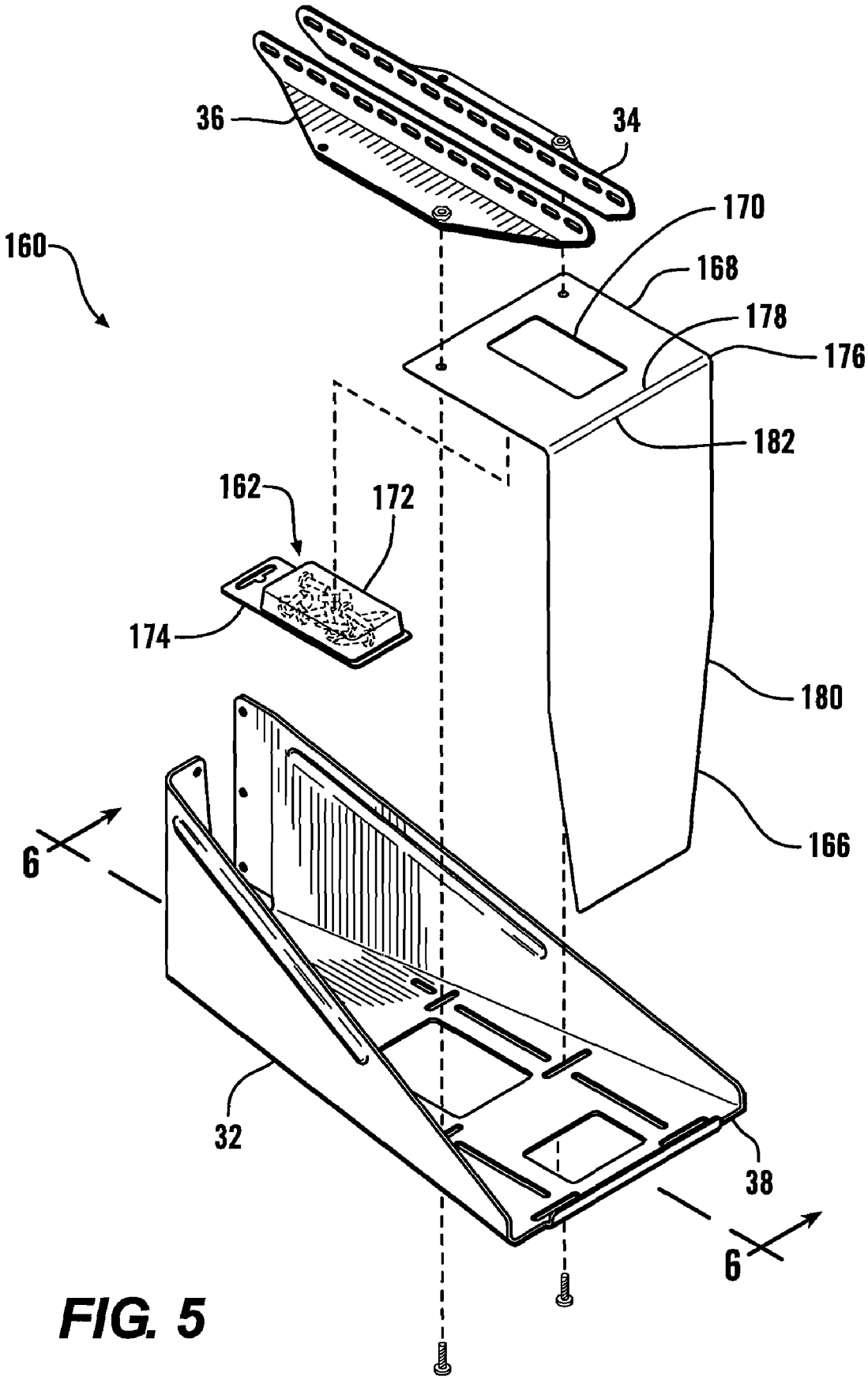
FIG. 5 is an exploded isometric view of a package assembly of the mounting assembly of FIG. 1 with a label and container with fasteners.
Figure 6:
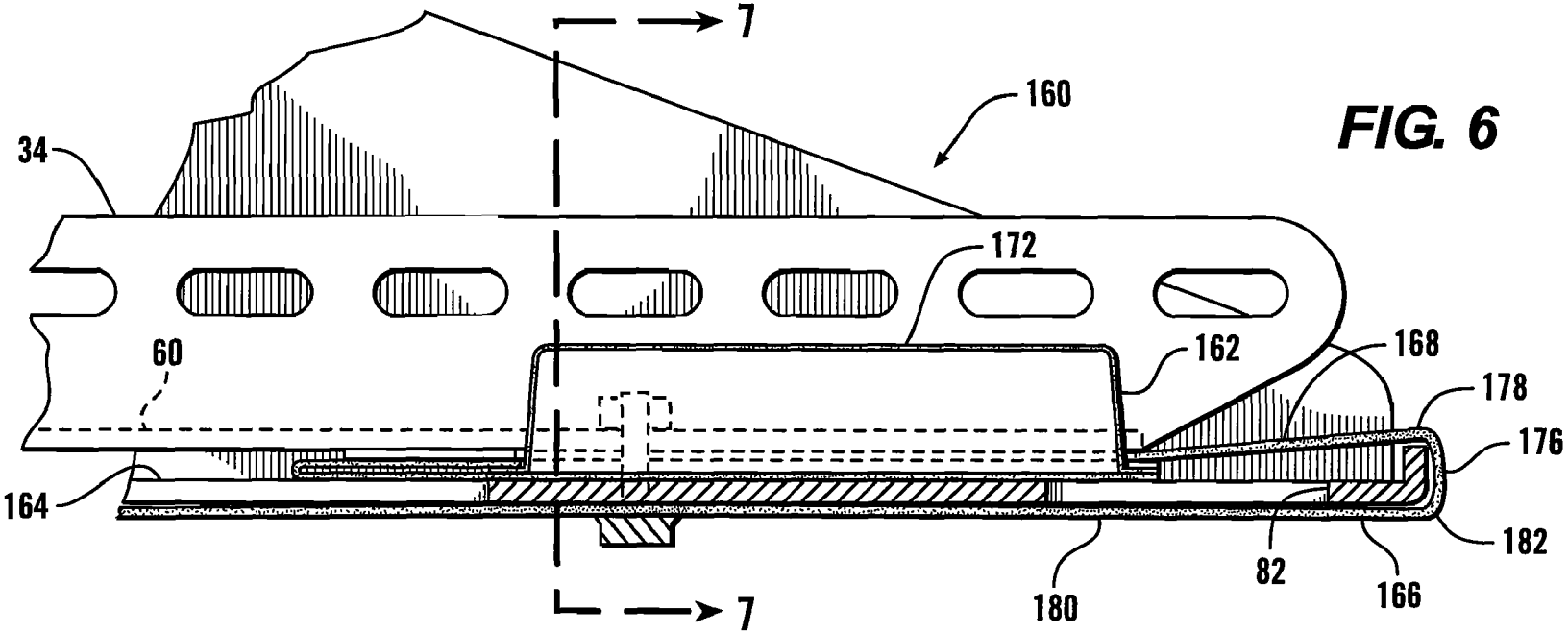
FIG. 6 is a cross-sectional view of the assembly of FIG. 5.
Figure 7:
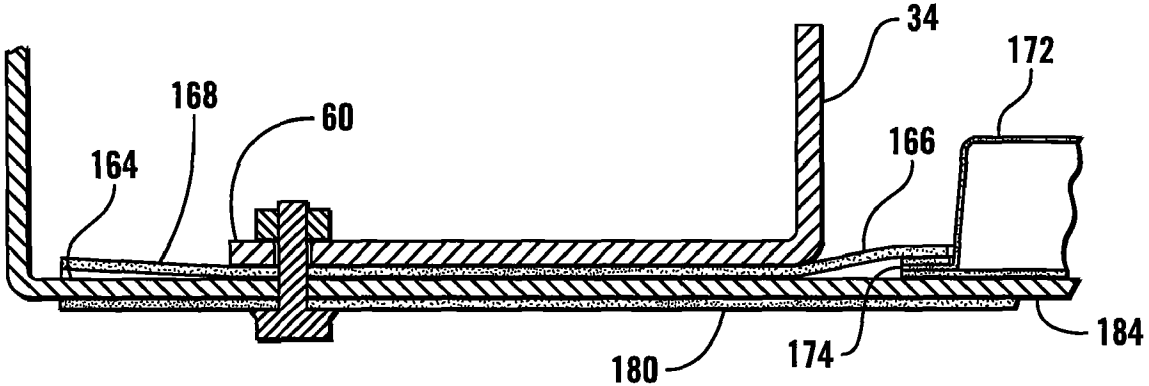
FIG. 7 is a cross-sectional view of the assembly of FIG. 6, taken along section line 7-7.

All the elements of the mounting assembly 20 of FIG. 1 may be compactly and economically packaged as shown in FIGS. 5-7. In the packaged assembly 160, all but two of the fasteners described above are enclosed within a conventional thermoformed plastic fastener container 162, which is then fastened to the main bracket 32 by a label 166 and two of the screw fasteners 66, which engage with the nuts 67 on the first and second top brackets 34, 36, which are positioned on the underside 164 of the top wall 38.

As shown in FIGS. 6 and 7, the main bracket 32 is inverted from its mounting position for presentation to customers in a retail setting. The label 166 is formed of sheet material such as cardstock, and has printed thereon indicia, not shown, related to the assembly 20. The label 166 has a first segment 168 with portions defining a container opening 170 through which the a product bubble 172 of the fastener container 162 product bubble protrudes. The fastener container 162 has a flange 174 which encircles the product bubble 172 and which is clasped by portions of the label 166. The label has a second segment 176 joined to the first segment 168 along a first fold line 178. A third segment 180 of the label 166 is joined to the second segment 176 along a second fold line 182 which is parallel to the first fold line 178. The first top bracket 34 and the second top bracket 36 are then positioned adjacent the underside 164 of the top wall with the first segment 168 of the label clamped therebetween, and with the third segment 180 of the label clamped to the top surface 184 of the top wall. Thus the label 166 is engaged by the fasteners 66 to the main bracket top wall 38 such that the main bracket top wall is secured between the label first segment and the label third segment, with portions of the fastener container engaged therebetween. The label second segment 176 will face frontwardly when a stack of nested packaged assemblies 160 is placed on a retail shelf, allowing a product description or other message to be printed on the second segment for ready reading by a customer.

Figure 3:
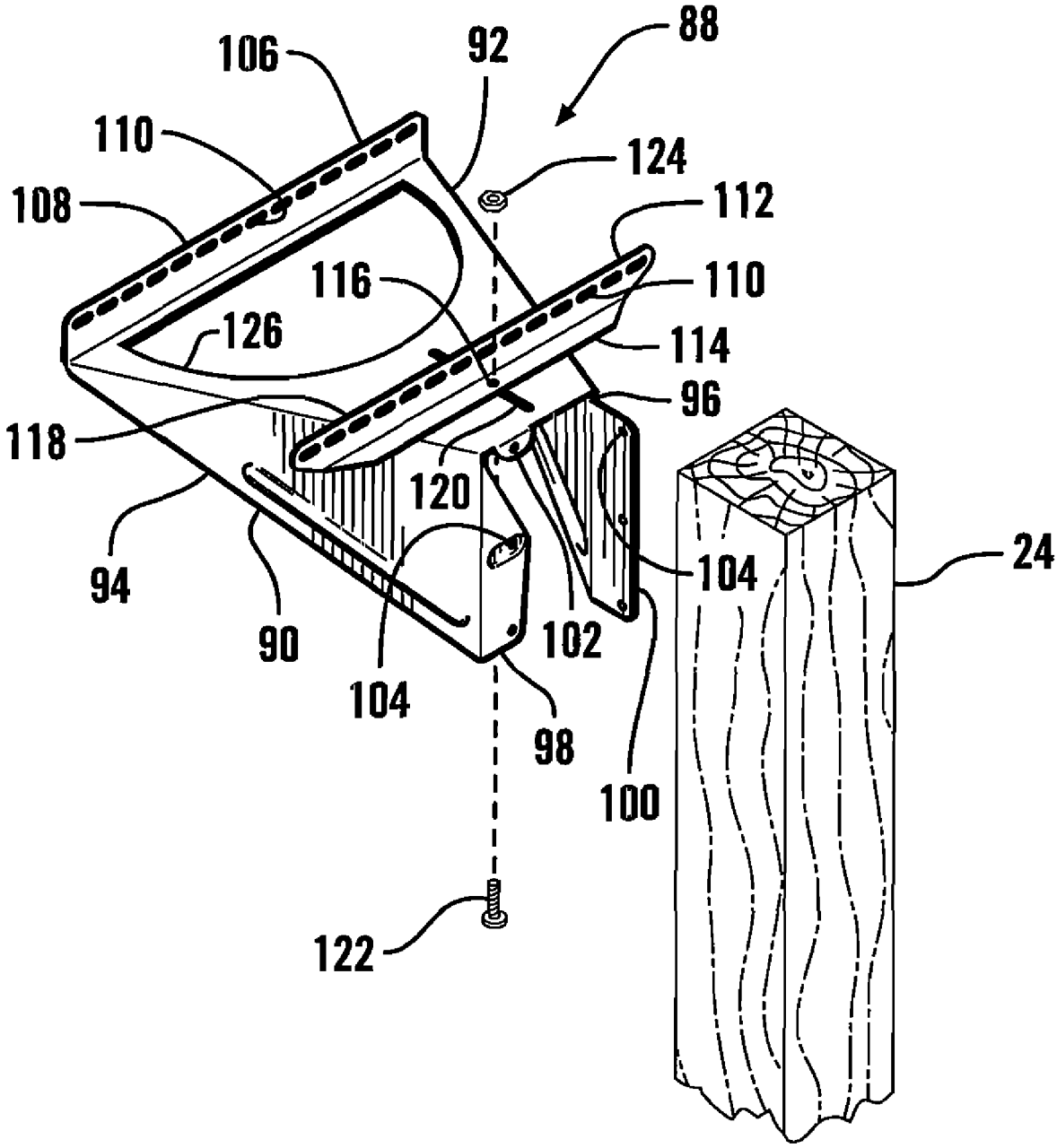
FIG. 3 is an isometric view of a first alternative mailbox mounting assembly of this invention shown in exploded view with respect to a post, and a second alternative mailbox mounting assembly of this invention mounted to the post to accommodate a first mailbox and another like assembly mounted to the post to accommodate a second, narrower mailbox.

An alternative embodiment mailbox mounting assembly 88 is shown in FIG. 3. The assembly 88 has fewer parts than the assembly 20 discussed above, but only allows mounting of the mailbox in a transverse arrangement, where it is spaced from the post. The assembly 88 has a main bracket 90 with a horizontal top wall 92 which underlies the mailbox 22. A first side wall 94 and a second side wall 96 are spaced from one another, and extend downwardly from the main bracket top wall 92. As in the assembly 20, the main bracket 90 is mounted to the post by a rear flange 98, a side flange 100 which extends from the second side wall in a plane which is perpendicular to the top wall and to the rear flange, and a top flange 102 which extends downwardly perpendicular to the top wall. Each of the side flange 100, the top flange 102, and the rear flange 98 has at least one attachment hole 104, through which fasteners may extend into the post.

A first top bracket 106 is formed integrally with the main bracket 90, and has a side segment 108 which extends upwardly from a bottom segment which is defined by the main bracket top wall 92 and is thus non-positionably fixed to the top wall. The side segment 108 has a plurality of aligned side slots 110. A second top bracket 112 has a bottom segment 114 which extends adjacent to the main bracket 90 top wall 92, and which has a fastener hole 116. A second side segment 118 extends upwardly from the bottom 114, and has a plurality of aligned side slots 110. A slot 120 is formed in the top wall 92 of the main bracket 90. The slot 120 extends in a first direction which extends outwardly from the post 24 towards the first side segment 108. The second top bracket 112 is connected to the main bracket 90 by a threaded fastener 122 which extends through the slot 120 and engages with a nut 124 which may be fastened to the second top bracket bottom segment 114, and which may be a PEMsert® insert. The second top bracket 112 may thus be fastened to the main bracket 90 at a variable distance from the first top bracket, such that the spacing between the parallel first top bracket side segment 108 and the second top bracket side segment may be adjusted.

The main bracket 90 top wall 92 is preferably provided with an access opening 126 which allows access to the bottom segment of the second top bracket when a mailbox is connected to the side segments of the first bracket and the second bracket. The assembly 84 may be fastened to the post 24 in a fashion similar to that described with respect to the assembly 20 above.

It will be noted that the second top bracket bottom segment 114 preferably extends away from the second top bracket side segment toward the post 24, to permit the downwardly extending lips of a mailbox to be conveniently fastened between the side segment slots of the first top bracket and the second top bracket.

It should be noted that, if the mounting assemblies of this invention are mounted to the post using screws, the assemblies can easily be removed and reattached to solve problems associated with setting the proper height for postal delivery.

It is understood that the invention is not limited to the particular construction and arrangement of parts herein illustrated and described, but embraces all such modified forms thereof as come within the scope of the following claims.

I claim:

1. An assembly for mounting a box to an upright post, the assembly comprising:

a main bracket having a horizontal top wall, the top wall extending in a first direction from a post edge to a free edge, a first side wall which extends downwardly from the top wall, and a second side wall spaced from the first side wall and which extends downwardly from the top wall;

portions of the main bracket which extend from the first side wall and the second side wall and which define fastener openings for mounting to the post;

portions of the main bracket top wall which define at least one first opening;

a first top bracket which has a side segment which extends upwardly from the top wall of the main bracket;

a second top bracket having a bottom segment which extends parallel and adjacent to the main bracket top wall, and a side segment which extends upwardly from the bottom segment, wherein portions of the first top bracket side segment and the second top bracket side segment define sidewardly opening fastener holes for engagement of the box; and wherein the second top bracket is positionably mounted to the main bracket, such that the second top bracket side segment is positioned in spaced relation to the first top bracket side segment, to permit the box to be engaged therebetween.

2. The assembly of claim 1 wherein the first side wall diverges from the second side wall as the walls extend in the first direction, such that the first side wall is not parallel to the second side wall.

3. The assembly of claim 1 wherein a second direction is defined perpendicular to the first direction, and wherein the first side wall is spaced from the second side wall in the second direction, and wherein the distance between the first side wall and the second side wall is greater at the free edge than at the post edge.

4. The assembly of claim 1 wherein the portions of the main bracket which extend from the first side wall and the second side wall comprise:

a rear flange which extends from the first side wall in a plane which is perpendicular to the top wall; and a side flange which extends from the second side wall in a plane which is perpendicular to the top wall and to the rear flange, the rear flange and the side flange positioned to engage perpendicular faces of the upright post for attachment of the main bracket thereto.

5. The assembly of claim 4 further comprising a top flange which extends downwardly from the top wall at the post edge and which extends in the plane of the rear flange.

6. The assembly of claim 4 wherein the portions of the main bracket which define fastener openings for mounting to the post comprise portions of the main bracket which define at least one fastener hole in each of the rear flange and the side flange; and further comprising portions of the main bracket which define raised crown portions around the at least one fastener hole in the rear flange and the side flange.

7. The assembly of claim 1 wherein the first top bracket side segment is integrally formed with the main bracket top wall and is thereby fixed thereto.

8. The assembly of claim 1 further comprising portions of the top wall which define a first pair of parallel second openings which extend in a direction perpendicular to the first direction.

9. The assembly of claim 8 further comprising a second first opening aligned with each first opening and spaced therefrom across one of the first pair of second openings.

10. The assembly of claim 1 wherein the first top bracket side segment extends upwardly from a bottom segment which extends parallel and adjacent to the main bracket top wall, the first top bracket being positionably mounted to the main bracket top wall.

11. The assembly of claim 10 further comprising:

two fasteners which extend from the first top bracket, the two fasteners being spaced from one another in a second direction perpendicular to the first direction a first distance in the second direction, wherein two fasteners extend from the second top bracket and are spaced from one another the first distance in the second direction; and portions of the top wall which define three pair of parallel second openings, the pairs of second openings being spaced from each other in the first direction, the spacing in the second direction between the openings of each pair of second openings being the first distance, such that each fastener extends into one of the second openings.

12. The assembly of claim 1, wherein the main bracket top wall defines two parallel first openings and the second top bracket is adjustable in spaced parallel relation to the first top bracket.

13. The assembly of claim 1 wherein the second top bracket is mounted to the main bracket by structure which extends between the second top bracket bottom segment and the main bracket top wall at the at least one first opening.

14. The assembly of claim 13 wherein the structure mounting the second top bracket to the main bracket comprises a fastener which extends through portions defining a fastener hole in the second top bracket bottom segment and through the at least one first opening.

15. An assembly for mounting a box to an upright post, the assembly comprising:

a main bracket having a horizontal top wall, the top wall extending in a first direction from a post edge to a free edge, a first side wall which extends downwardly from the top wall, and a second side wall spaced from the first side wall and which extends downwardly from the top wall;

a first attachment flange which extends from one of the top wall and the side walls;

a second attachment flange which extends from the other of said top wall and said side walls, wherein both the first attachment flange and the second attachment flange are perpendicular to the top wall, and wherein the first attachment flange is perpendicular to the second attachment flange, the first attachment flange and the second attachment flange having portions defining fastener openings therethrough and being positioned to engage perpendicular faces of the upright post for attachment of the main bracket thereto;

portions of the main bracket top wall which define at least one first opening;

a top mounting assembly having a first side segment which extends upwardly from the top wall of the main bracket, and a second side segment spaced parallel to the first side segment which also extends upwardly from the top wall of the main bracket, wherein portions of the first side segment and the second side segment define sidewardly opening fastener holes for engagement of the box; and wherein the top mounting assembly with the engaged box is mountable to the top wall of the main bracket.

16. The assembly of claim 15 wherein a second direction is defined perpendicular to the first direction, and wherein the first side wall is spaced from the second side wall in the second direction, and wherein the distance between the first side wall and the second side wall is greater at the free edge than at the post edge.

17. The assembly of claim 15 further comprising portions of the top wall which define a first pair of parallel second openings which extend in a direction perpendicular to the first direction.

18. The assembly of claim 15 wherein the top mounting assembly is connected to the main bracket at the at least one first opening by at least one fastener extending between the top mounting assembly and the main bracket at the at least one first opening.

* * * * *